US006279764B1

(12) United States Patent
Stoof

(10) Patent No.: US 6,279,764 B1
(45) Date of Patent: Aug. 28, 2001

(54) HOISTING DEVICE

(75) Inventor: Pieter Maria Stoof, Breda (NL)

(73) Assignee: Mammoet Decalift International B.V., Amsterdam (NL)

( * ) Notice: Subject to any disclaimer, the term of this patent is extended or adjusted under 35 U.S.C. 154(b) by 0 days.

(21) Appl. No.: 09/125,939

(22) PCT Filed: Feb. 28, 1997

(86) PCT No.: PCT/NL97/00099

§ 371 Date: Dec. 4, 1998

§ 102(e) Date: Dec. 4, 1998

(87) PCT Pub. No.: WO97/31855

PCT Pub. Date: Sep. 4, 1997

(30) Foreign Application Priority Data

Feb. 29, 1996 (NL) ..... 1002482

(51) Int. Cl.[7] ..... B66C 23/70

(52) U.S. Cl. ..... 212/177; 212/179; 212/195

(58) Field of Search ..... 212/177, 178, 212/179, 180, 181, 298, 307, 308, 309, 310, 195, 196, 198, 262, 252

(56) References Cited

U.S. PATENT DOCUMENTS

| | | | | |
|---|---|---|---|---|
| 739,955 | * | 9/1903 | De Vou | 212/198 |
| 2,051,497 | * | 8/1936 | Sasgen et al. | 212/177 |
| 3,557,969 | * | 1/1971 | Heyer | 212/177 |
| 3,777,900 | * | 12/1973 | Brewer | 212/179 |
| 3,868,022 | * | 2/1975 | Greenlay et al. | 212/48 |
| 3,921,815 | | 11/1975 | Brown et al. | 212/3 |
| 4,016,974 | | 4/1977 | Tax | 206/321 |
| 4,093,042 | * | 6/1978 | Pradon | 188/67 |
| 4,297,961 | * | 11/1981 | Johnson | 212/308 |
| 5,035,337 | * | 7/1991 | Juergens | 212/196 |

FOREIGN PATENT DOCUMENTS

| | | | | |
|---|---|---|---|---|
| 1083523 | * | 6/1960 | (DE) | 212/195 |
| 37210 | * | 7/1969 | (FI) | 212/195 |
| 1425633 | * | 12/1965 | (FR) | 212/262 |
| 2196603 | * | 5/1988 | (GB) | 212/307 |
| 394286 | * | 1/1974 | (SU) | 212/298 |
| 1321666 | * | 7/1987 | (SU) | 212/195 |

* cited by examiner

*Primary Examiner*—Thomas J. Brahan
(74) *Attorney, Agent, or Firm*—Joan H. Pauly

(57) ABSTRACT

A hoisting device (1) comprises at least a hoisting mast (7), a foot (4) arranged on the underside and connected to the hoisting mast, and a lifting device (6) connected at least to the top of the hoisting mast (7). The hoisting device (1) is assembled from components or elements (8), the largest of which has dimensions which do not exceed those of a normal container, whereby the entire hoisting device (1) can be transported easily and inexpensively by land, sea or air.

24 Claims, 9 Drawing Sheets

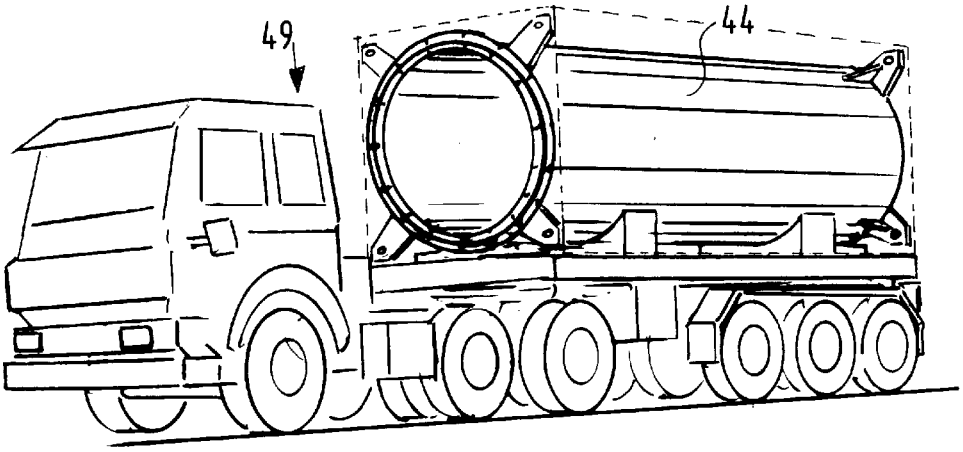
FIG.8
FIG.7
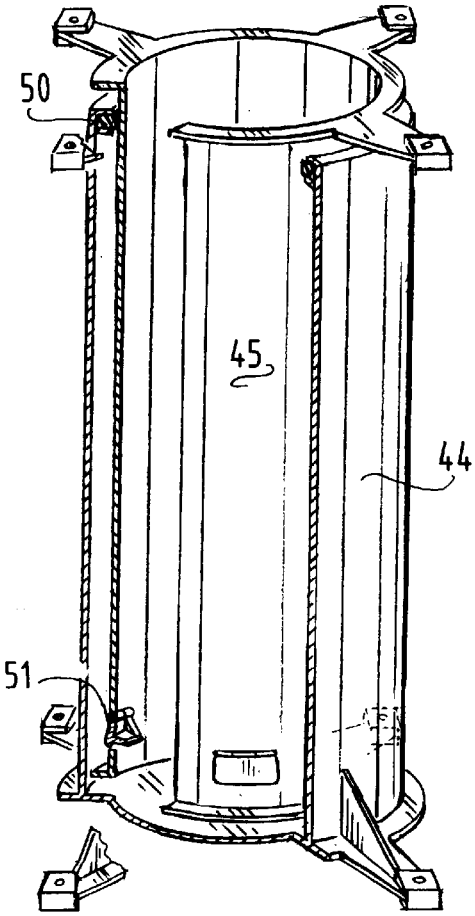

HOISTING DEVICE

The invention relates to a hoisting device comprising a boom and a mast, both with one end pivotably arranged to each other, a counterweight attached to the free end of the mast and hoisting means connected to at least the free end of the boom, wherein said free end of the mast and said free end of the boom are connected by cables.

Such hoisting devices are generally known, especially from U.S. Pat. No. 3,921,815. When such hoisting devices serve for hoisting heavy and/or large voluminous loads, these cranes are bulky and heavy.

Large mobile cranes with for instance caterpillar tracks as displacing elements can only be disassembled into large units such as jib, counterweight and chassis, and can in fact only be transported by ship or large truck in fact to locations for hoisting jobs. In the case transport takes place by truck, a special license is generally required for such a journey in respect of standard dimensions and weights for normal road traffic being exceeded.

Hoisting operations can often be performed on navigable water, but in other cases hoisting operations have to be carried out far inland, wherein transport overland forms a particular problem.

The object of the present invention is to provide a hoisting device which is suitable for hoisting loads up to 10,000 tons to a height of 100 metres, which can be transported easily and at low cost, and which requires a short time duration for putting into use at the location of the hoisting job, irrespective of the required hoisting height and load weight.

This object is achieved in that the hoisting device is assembled from components or elements, the largest of which has dimensions which do not exceed those of a standardized sea container and that both pivotably arranged ends of the boom and mast respectively, are pivotably arranged to a support plate, which is supported on the same base as the counterweight.

It will be apparent that transporting means are present all over the world for transporting standardized sea containers. These are for transport by sea and by road, by (See further original description page 2, line 1) rail or by air. Because according to the invention the hoisting device can also be disassembled into components which do not exceed the dimensions of the normal container for transport, these can be transported in the same easy manner as a normal container or therein.

The components which are intended for the mast parts (posts) are preferably tubular. These are substantially under strain of axial pressure. Not only can they be coupled as containers (if necessary) during transport, but they are also embodied such that they can form a post with coupling options for arranging shores, wind bracings and additional framework elements in order to arrive at an assembled post comparable to a kite construction.

The present invention is further elucidated hereinbelow with reference to the annexed drawing. In the drawing:

FIG. 7 shows a partly broken away perspective view of a portion of the counterweight depicted in FIG. 6;

FIG. 8 is a perspective view of a construction shown in the figures during transport;

FIGS. 9 to 16 schematically show possible applications.

Figure 1:
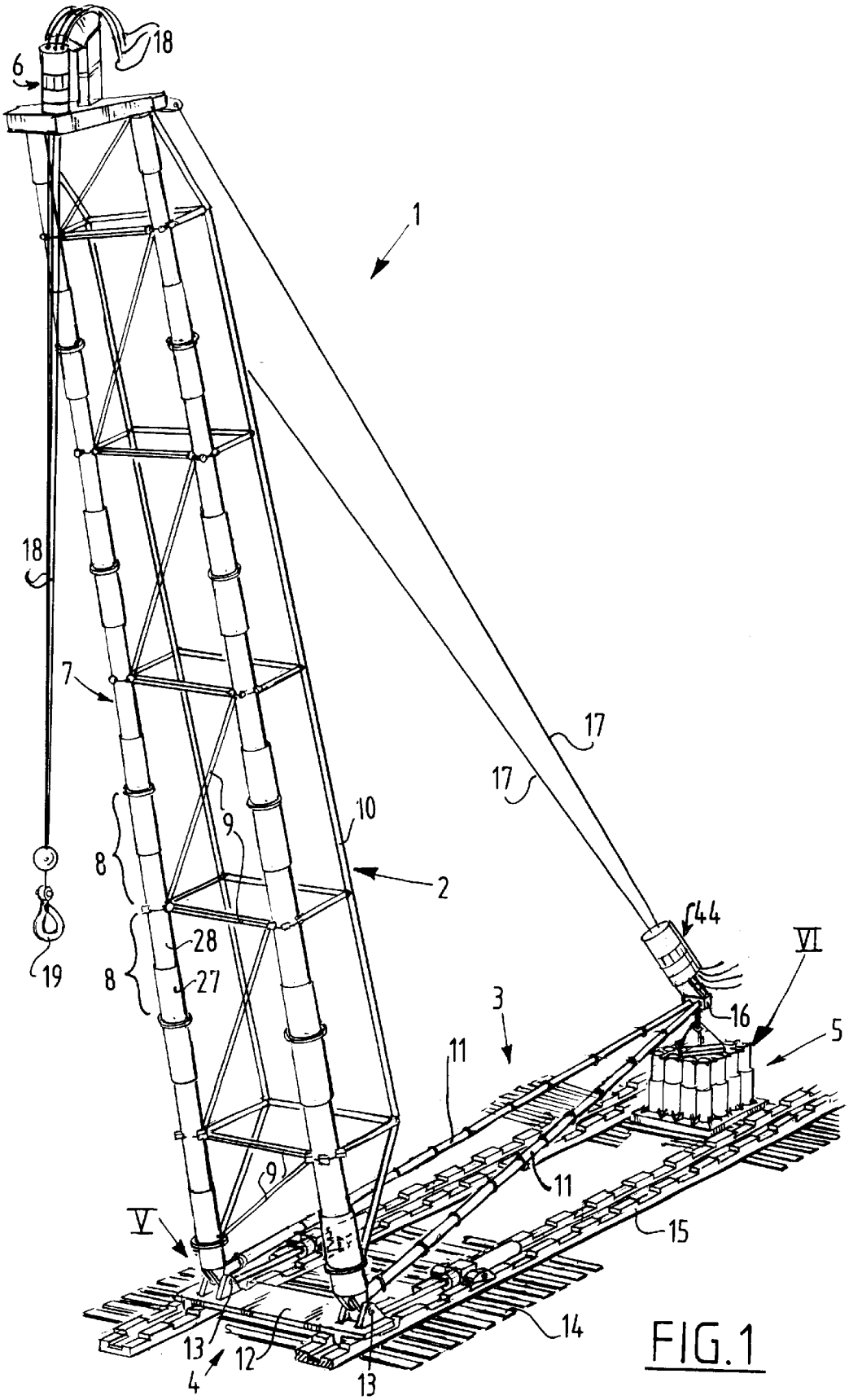
FIG. 1 shows a perspective view of a first embodiment of a hoisting device according to the invention.

FIG. 1 shows a hoisting device 1 which in this embodiment is formed by a hoisting jib 2, a rear jib 3, a foot 4, a counterweight 5 and a hoisting element 6.

Hoisting jib 2 is formed by two posts 7 which here are each assembled from retractable and extending elements which are further elucidated hereinafter. Both posts 7 are mutually connected by means of a cross brace 9, wherein a pull rod construction is for instance arranged on the rear of both posts in order to prevent bending.

It is noted herein that not only are the posts 7 each detachable into elements 8, which can easily be transported separately, but that the same applies for the elements of the cross brace 9 and of the construction 10.

Rear jib 3 is formed by two posts 11 which are likewise each assembled from separate elements.

Foot 4 is formed by a support plate 12 to which posts 7 and 11 are pivotally connected to the support plate 12 by means of pivots 13. Support plate 12 is further moveable in linear direction over a track 14 which will be elucidated with reference to the other figures. Use is herein made of rails 15.

At the end of rear jib 3 both posts 11 are mutually connected in a block 16. This block 16 is connected to a counterweight which is designated as a whole by 5 and which will be described with reference to one of the following figures. Block 16 is connected by means of guys 17 to the top of hoisting jib 2.

At the top of hoisting jib 2 is further arranged a lifting element 6 which is intended for raising hoisting cable 18 in vertical direction, on the underside of which cable is fixed a hook 19 or possibly another fixing means, for example a sling. Such a lifting device 6 is formed by a for instance hydraulically driven element which is moveable stepwise in vertical direction and which separately grips strands of the hoisting cable. Such lifting devices are known in the prior art and the operation will not be elucidated further. It is otherwise equally possible to make use of other lifting apparatus, wherein the hoisting cable is guided over a block at the top of the jib, and wherein the hoisting cable is then possibly guided via a second block to a winch or the like (not shown).

However, in respect of the easy transportability the use of a lifting device 6 as according to FIG. 1 is easier and simpler.

It is noted that such a lifting device 6 can also be used in the guys, see element 44, in order to enable erection of the mast during assembly. If desired, such a lifting device can also be arranged between counterweight 5 and block 16 of post 11.

Figure 2:
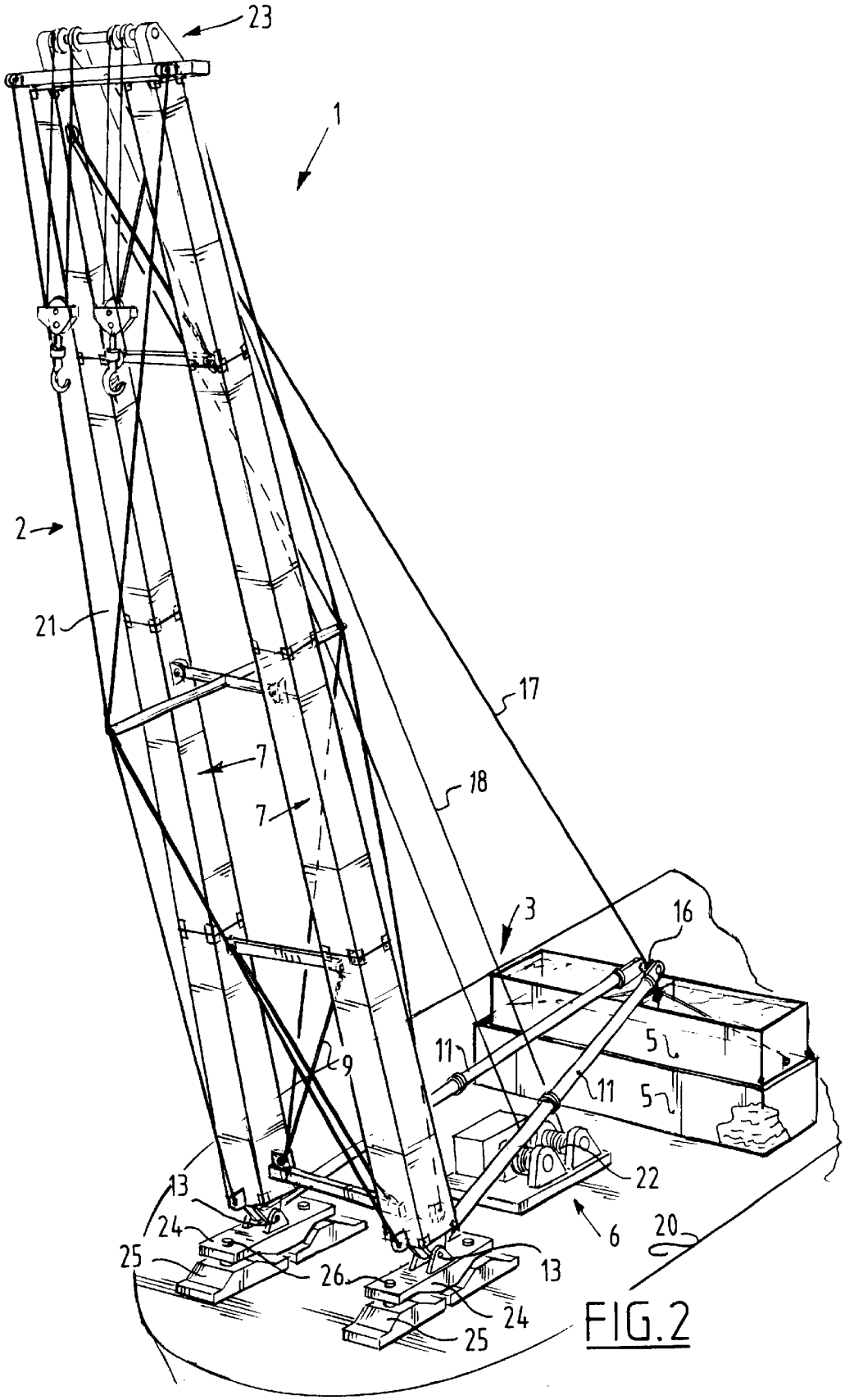
FIG. 2 shows a perspective view of a second embodiment of a hoisting device according to the invention.

In FIG. 2 another embodiment of the hoisting device according to the invention is shown. In this embodiment, wherein corresponding components are designated with the same numerals as the embodiment shown in FIG. 1, there is a hoisting jib 2, the dimensions of which can be smaller than in the embodiment shown in FIG. 1.

This embodiment is particularly suitable for assembly on a platform, for example on a floating derrick. The invention is then also of importance for instance for carrying out hoisting operations in waters which are not in communication with the open sea and which must be reached by land. The construction shown in FIG. 2 further comprises a kite construction 21 to provide hoisting jib 2 with sufficient resistance to deflection.

Another difference from the embodiment shown in FIG. 1 lies in the fact that in FIG. 2 use is made of a double winch 22 which is fixed onto a platform and on which the-hoisting cable 18 is wound, which hoisting cable 18 is further guided via a guide block 23 arranged at the top of hoisting jib 2. The pivots 13 are connected to two separate fixing shoes 24 which, because of their shape, fit into shoes 25 welded onto platform 20. Fixing further takes place by means of bolts 26.

Figures 3, 4:
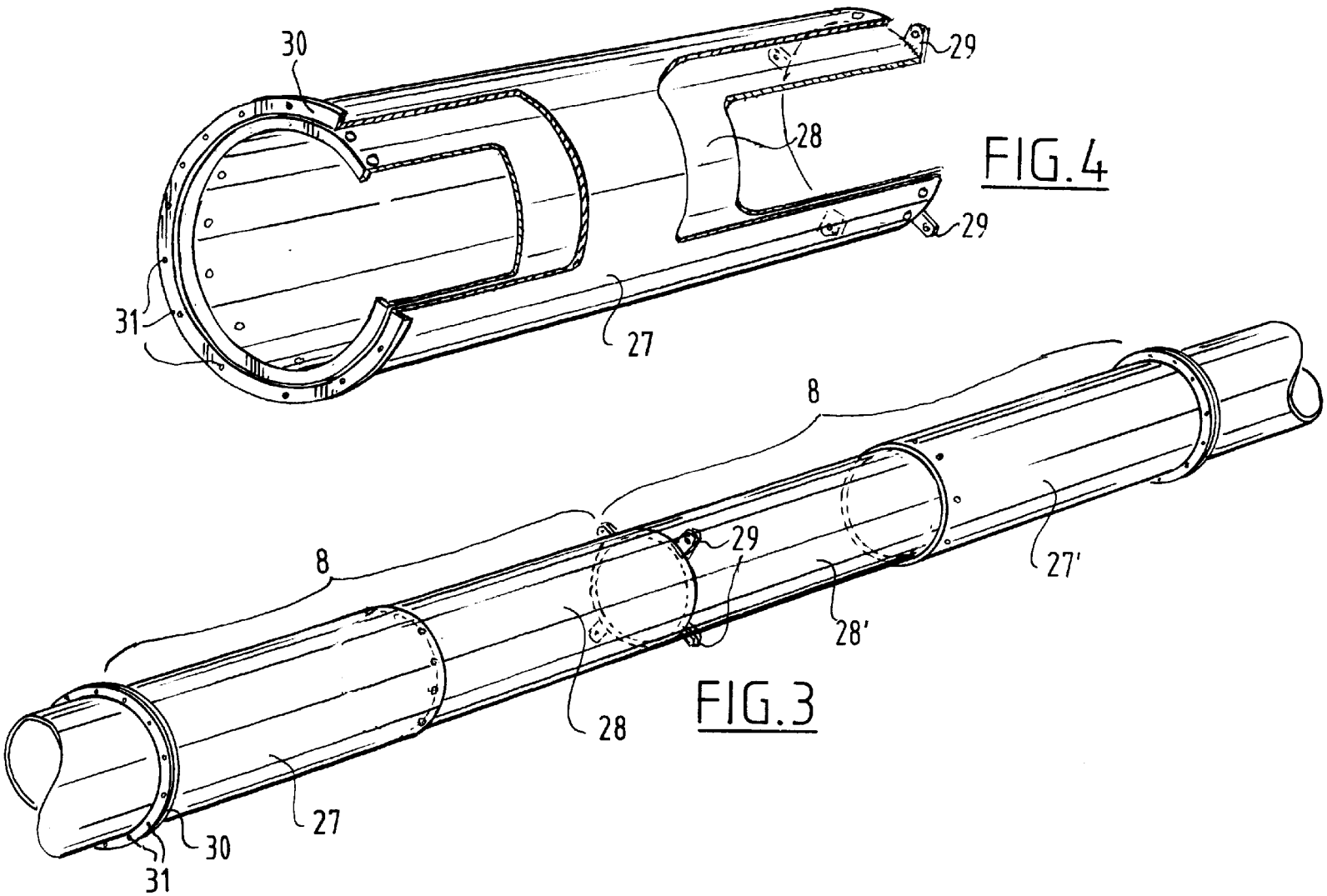
FIG. 3 is a broken away view of a detail of a hoisting mast according to the invention.
FIG. 4 is a detail view of an element of the hoisting mast depicted in FIG. 3 in retracted form.

FIG. 3 shows a detail of the post 11 of jib 2 in FIG. 1. This shows that post 11 is formed by elements 8 which are formed in each case from two concentric pipes 27, 28. The pipes 27 and 28 herein have an unequal diameter so that they can slide into each other. Pipes 27 and 28 further have approximately the same length. The length 35 of each pipe part is slightly shorter than the internal length of a normal 40 or 20-foot container. This means that in the situation where pipes 27 and 28 are pushed into each other the whole assembly fits inside a 40 or 20-foot container. It is otherwise also possible to base the whole system on 10-foot container dimensions.

For fixing to a following element 8 the broad pipes 27 are provided on their distal end with a coupling flange 30, which is embodied with holes 31 with which connection can be made to a corresponding flange of a connecting element 8. For mutual connection and locking of pipes 28 use can be made of various techniques, for example the ears 29 shown in the drawings into which connecting pins can be inserted. It is also possible to use these for the fastening to the cross brace 9. It is noted that the external size of the part 8 does not exceed that of a normal container.

FIG. 4 shows the part 8 of the construction depicted in FIG. 3; the elements 27, 28 respectively are herein pushed into each other for transport purposes.

Figure 5:
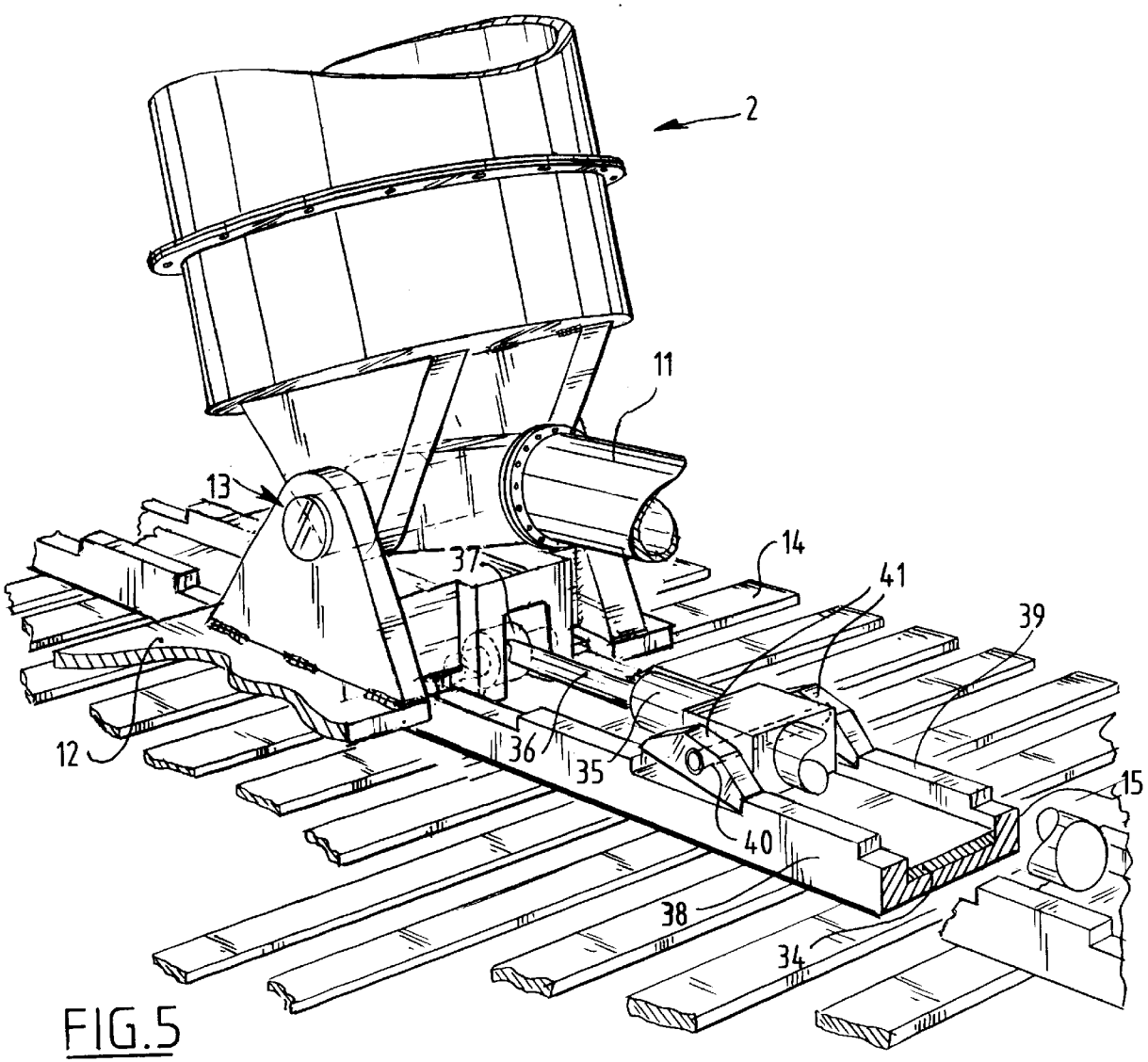
FIG. 5 is a perspective, partly broken away detail view of the foot of a hoisting device according to the invention.

In FIG. 5 is shown the construction of the pivot 13 in addition to a mechanism with which footplate 12 can be moved over rail 15. A hydraulic jack 35 serves to drive the footplate 12 over the rail which has a substantially U-shaped cross section.

Guidable in the channel are shoes 34 to which the hydraulic cylinder 35 is fixed. The piston rod 36 of the hydraulic cylinder is connected to footplate 12 by means of a pivot 37. Shoes 34 can be fixed inside rail 15 by means of protrusions 39 arranged in the side walls 38 of the rail. For this purpose the shoe is connected by means of a shaft 40 to two locks 41 which can be placed into engagement with protrusions 39.

By means of the rail which is supported on cross beams 14 it is possible to place the shoe repeatedly in locking engagement with the rail at different points, so that footplate 12 can be placed repeatedly through a short distance by means of one stroke of hydraulic cylinder 35. Large displacements can be realized by repeating this process and placing the lock in engagement with a different protrusion each time. It will be apparent that the stroke of the cylinder must be at least as large as the pitch of the protrusions.

It may be that in addition to footplate 12 the counterweight 5 must also be displaced. Use can be made for this purpose of a similar, for instance synchronously operating drive system, but it is also possible to make a rigid connection between these two parts.

In the present embodiment there are two parallel rails. By making use of four rails ordered in a suitable pattern and by making use of four contact points between the rails and the footplate, it is possible to cause the footplate and the construction arranged thereon to rotate through an angle of at least 90°.

The counterweight can be formed by two or more containers open at the top which fit into each other. By placing them on each other both can be filled with water, sand, gravel, rocks, steel or other available material. These bins can also be formed from normal containers or by vessels which can be joined together as in the case of containers.

It is herein also possible, for instance when using water and/or sand as counterweight, to make the containers retractable and extending and subsequently lockable, so that the content can be increased.

Figure 6:
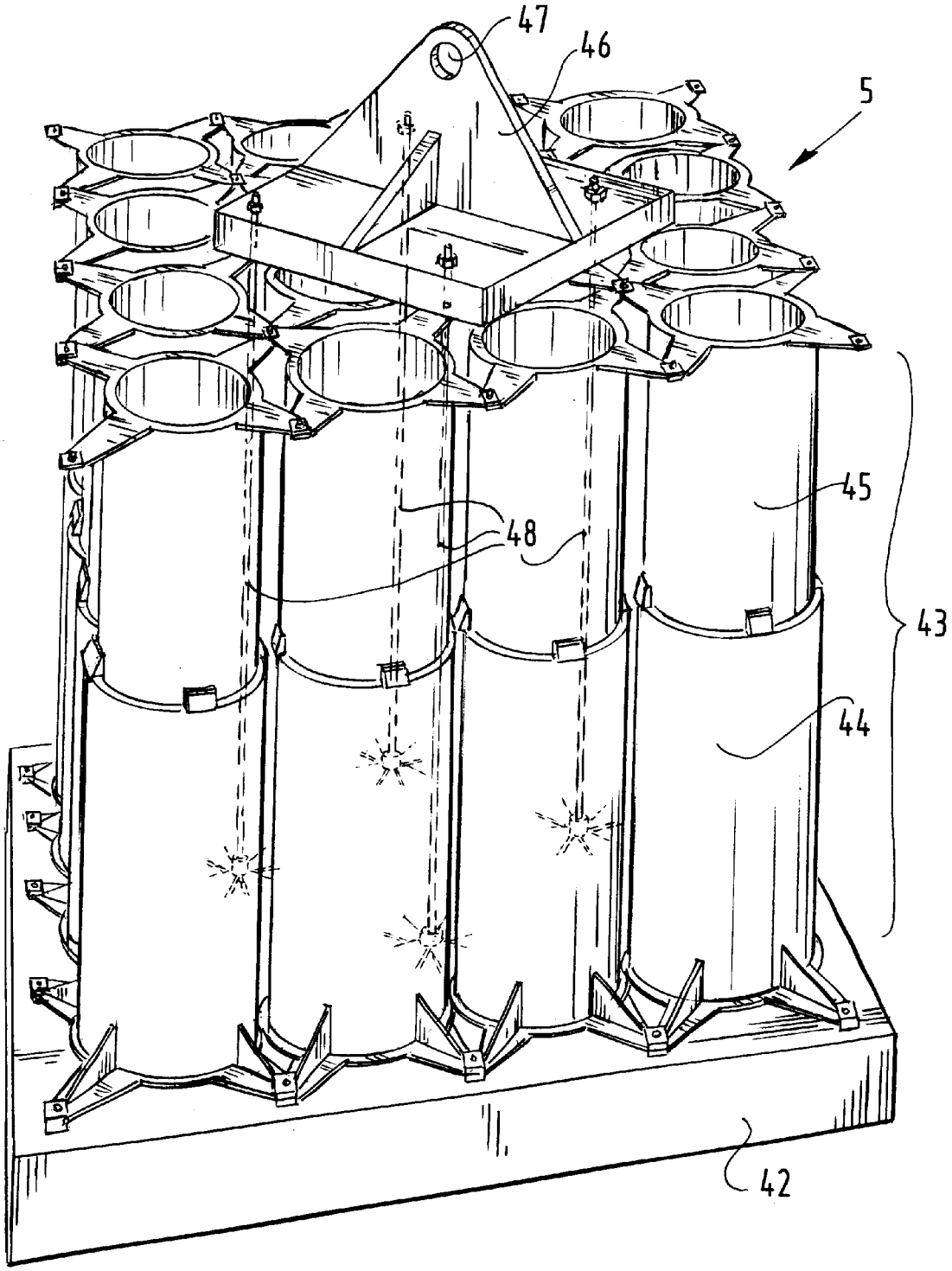
FIG. 6 shows a perspective view of a counterweight according to the present invention.

FIGS. 6 and 7 show another embodiment of the counterweight. The counterweight 5 is formed by a plate 42 having placed thereon cylindrical holders 43 which each consist of a bottom piece 44 and a top piece 45, wherein each of the top pieces 45 is slidable inside the bottom pieces 44 and wherein, if desired, a seal is maintained between both pieces if water is used as filling. The end surfaces of each of the pieces 44, 45 are once again provided with fixing ears which correspond with those of a normal container, so that the assembly can be easily moved. The relevant fixing ears can further be used for mutually fixing the cylindrical holders 43.

FIG. 7 also shows how both cylinders 44, 45 slide into each other, wherein the liquid seal between the cylinders is maintained by means of a large O-ring 50 and the mutual position of cylinder halves 44, 45 can be maintained by means of locks 51.

The holders can be filled with locally available material, for example water, gravel, sand, boulders, etc. To allow engagement of the guys use is made of a fixing block 46 which is provided with an eye 47 and which is connected to bottom plate 42 by means of pull rods 48.

FIG. 8 herein shows how such a holder 44 in the retracted situation is transported in its entirety on a truck 49.

Because the invention provides separate kit elements, it is possible to form many configurations thereof.

Figure 9:
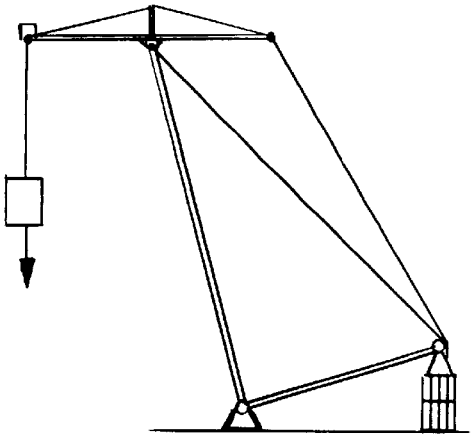
Figure 10:
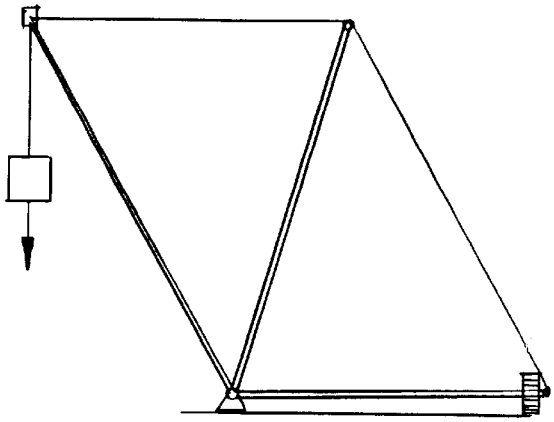
Figure 11:
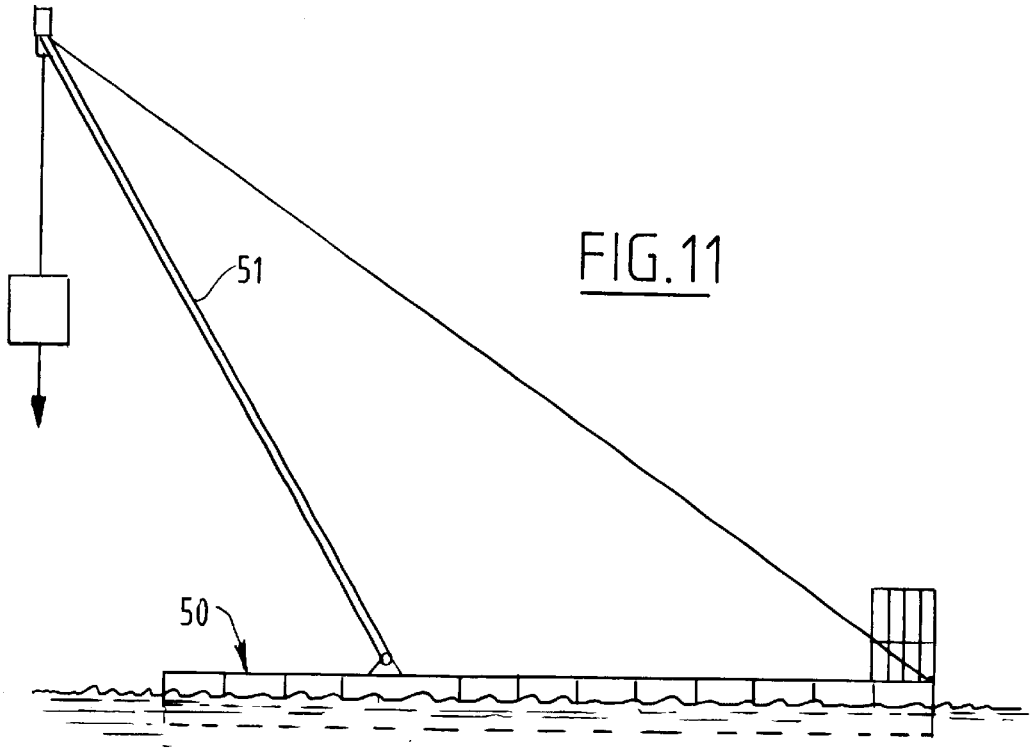

FIGS. 9 and 10 are two practical embodiments while FIG. 11 is a pontoon 50 formed from container-like and coupled elements, on which pontoon a hoisting device 51 is placed in order to thus form a floating crane. Adapted standard pontoons with hoisting device 51 thereon can also be used.

Figure 12:
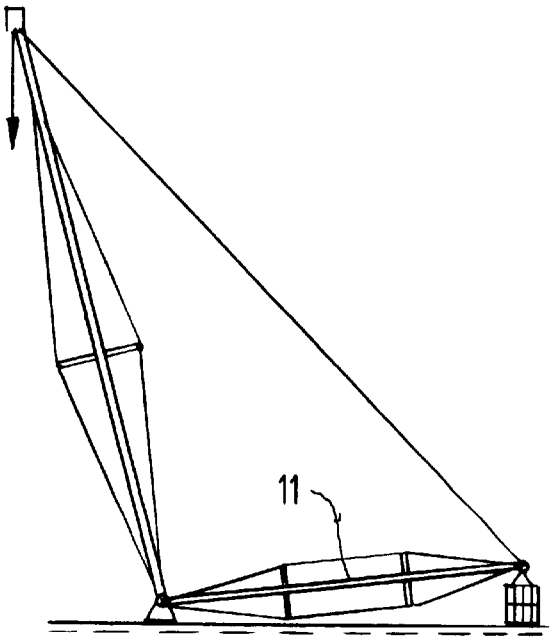

FIG. 12 shows a side view of the hoisting device wherein, in addition to the main post, the rear mast 11 is also embodied as in FIG. 2 as a so-called kite construction.

Figure 13:
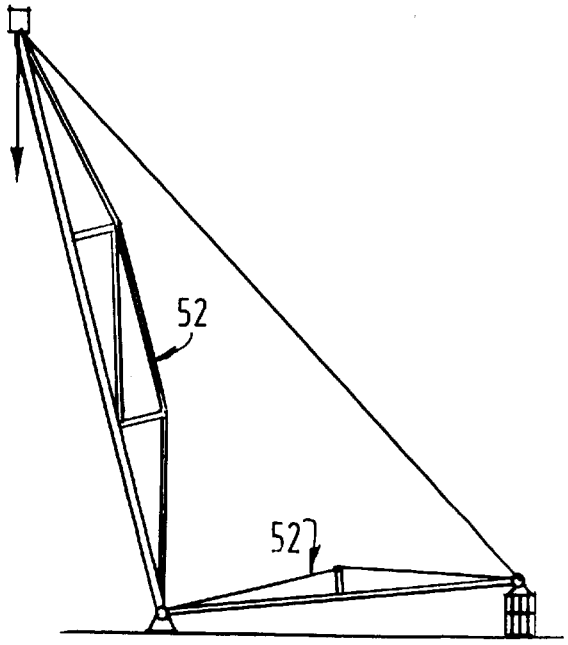

FIG. 13 shows an alternative stabilization against deflection by arranging pull-push rods 52 on one side, also see the rear jib.

Figure 14:
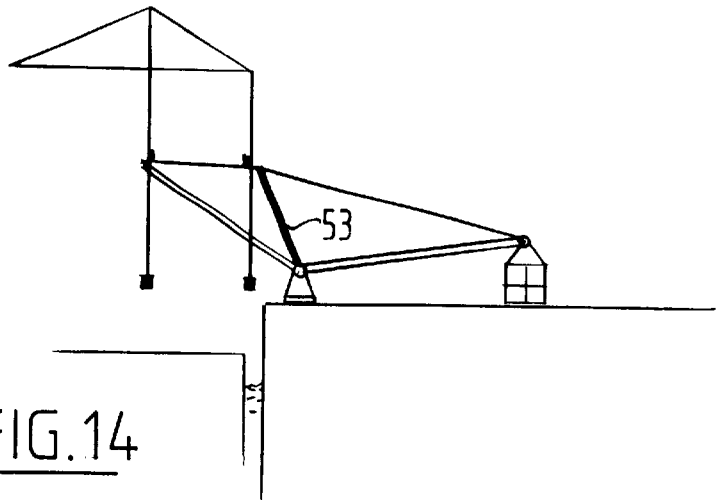

FIG. 14 shows the hoisting device wherein by adding an additional pair of masts (posts) 53, large objects, for instance container cranes, are pushed or displaced upward.

Figure 15A:
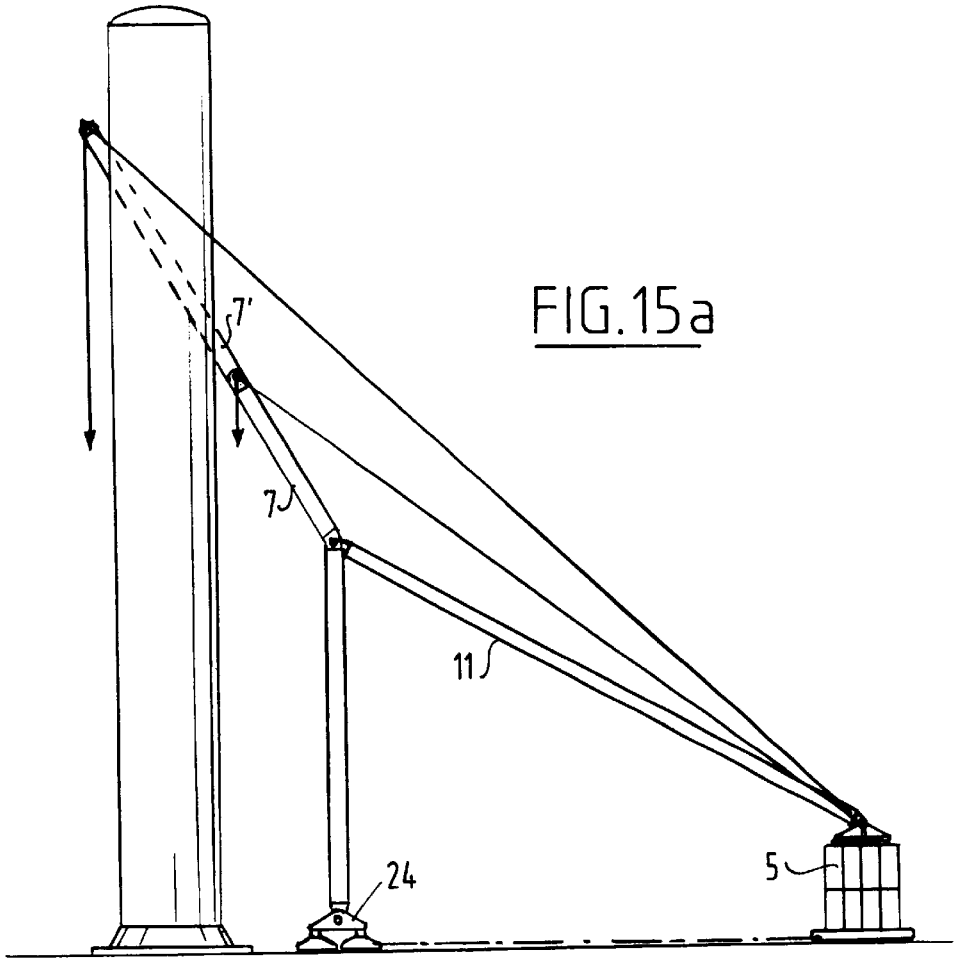
Figure 15B:
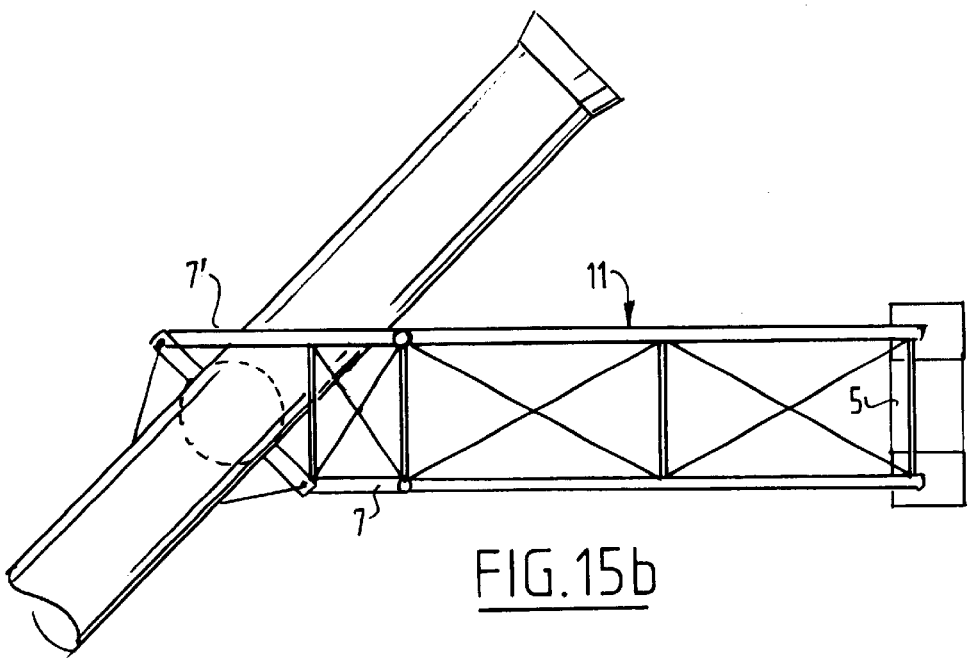

FIGS. 15*a*, 15*b* show the hoisting device wherein, by adding one longer jib 7 to the top of the posts which are here bent, heavy, long loads higher than the hoisting masts can be hoisted or moved.

Figure 16:
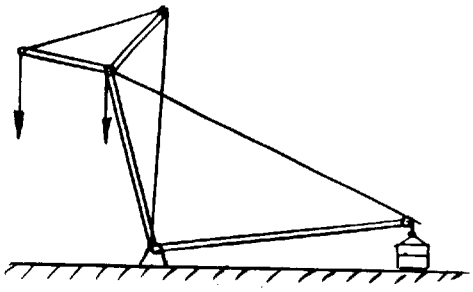

FIG. 16 shows the hoisting device wherein special hoisting projects can be performed by adding an auxiliary mast to the top of the posts.

It will be apparent that all these embodiments are assembled in a manner as shown and described with reference to FIG. 1 to 7.

What is claimed is:

1. Hoisting device comprising a boom (2) and a mast (3), both with one end pivotably arranged to each other, a counterweight (5) attached to the free end of the mast (3) and a lifting device connected to at least the free end of the boom (2), wherein said free end of the mast (3) and said free end of the boom (2) are connected by cables (17), characterized in that:

the hoisting device is assembled from components or elements, the largest of which has dimensions which do not exceed those of a standardized sea container of an 8 foot by 8 foot by 40 foot size; both pivotably arranged ends of the boom (2) and mast (3), respectively, are pivotably arranged to a support plate (12, 24), which is supportable on the same base, not a part of the hoisting device, as the counterweight (5); and at least some of said elements include couplings corresponding to a standardized sea container, to enable said some of said elements to be handled during transport in the same manner as standardized sea containers, said couplings being part of said some of said elements when the hoisting device is assembled in a use configuration and when the hoisting device is disassembled for transport.

2. Hoisting device according to claim 1, characterized in that said support plate (12, 24) and said counterweight are supportable on a rail and are configured to be movable along the rail (15).

3. Hoisting device according to claim 2, characterized in that said some of said elements include elements that are assembled to form at least one of the boom (2) and the mast (3).

4. Hoisting device according to claim 3, characterized in that, the elements (8) are formed by at least two extending, concentric tubular bodies (27, 28), which are slidable relative to each other, one into the other, and which are lockable relative to each other in their extended position.

5. Hoisting device according to claim 1, characterized in that, said base is a deck (20) of a vessel.

6. Hoisting device according to claim 5, characterized in that said some of said elements include elements that are assembled to form at least one of the boom (2) and the mast (3).

7. Hoisting device according to claim 6, characterized in that, the elements (8) are formed by at least two extending, concentric tubular bodies (27, 28), which are slidable relative to each other, one into the other, and which are lockable relative to each other in their extended position.

8. Hoisting device according to claim 1, characterized in that said some of said elements include elements that are assembled to form at least one of the boom (2) and the mast (3).

9. Hoisting device according to claim 8, characterized in that, the elements (8) are formed by at least two extending, concentric tubular bodies (27, 28), which are slidable relative to each other, one into the other, and which are lockable relative to each other in their extended position.

10. Hoisting device according to claim 9, characterized in that, the lifting device (6) is formed by a stepwise movable gripping element for a hoisting cable (18).

11. Hoisting device according to claim 8, characterized in that, the lifting device (6) is formed by a stepwise movable gripping element for a hoisting cable (18).

12. Hoisting device according to claim 1, characterized in that, the counterweight (5) is formed by at least one fillable element (43).

13. Hoisting device according to claims 12, characterized in that, the lifting device (6) is formed by a stepwise movable gripping element for a hoisting cable (18).

14. Hoisting device according to claim 12, characterized in that, the fillable elements (43) are mutually connectable.

15. Hoisting device according to claim 14, characterized in that said some of said elements include elements that are assembled to form at least one of the boom (2) and the mast (3).

16. Hoisting device according to claim 15, characterized in that, the elements (8) are formed by at least two extending, concentric tubular bodies (27, 28), which are slidable relative to each other, one into the other, and which are lockable relative to each other in their extended position.

17. Hoisting device according to claim 16, characterized in that, the fillable elements (43) are formed by extending cylinders (44, 45).

18. Hoisting device according to claim 15, characterized in that, the fillable elements (43) are formed by extending cylinders (44, 45).

19. Hoisting device according to claim 14, characterized in that, the fillable elements (43) are formed by extending cylinders (44, 45).

20. Hoisting device according to claim 19, characterized in that, the lifting device (6) is formed by a stepwise movable gripping element for a hoisting cable (18).

21. Hoisting device according to claim 14, characterized in that, the lifting device (6) is formed by a stepwise movable gripping element for a hoisting cable (18).

22. Hoisting device according to claim 12, characterized in that, the fillable elements (43) are formed by extending cylinders (44, 45).

23. Hoisting device according to claim 10, characterized in that, the lifting device (6) is formed by a stepwise movable gripping element for a hoisting cable (18).

24. Hoisting device of claim 1, wherein said support plate is displaceable relative to the base independently of said counterweight.

* * * * *